US009103119B2

(12) United States Patent
Foderberg

(10) Patent No.: US 9,103,119 B2
(45) Date of Patent: Aug. 11, 2015

(54) TIE SYSTEM FOR INSULATED CONCRETE PANELS

(71) Applicant: Joel Foderberg, Overland Park, KS (US)

(72) Inventor: Joel Foderberg, Overland Park, KS (US)

( * ) Notice: Subject to any disclaimer, the term of this patent is extended or adjusted under 35 U.S.C. 154(b) by 66 days.

(21) Appl. No.: 14/265,931

(22) Filed: Apr. 30, 2014

(65) Prior Publication Data

US 2015/0167303 A1 Jun. 18, 2015

Related U.S. Application Data

(60) Provisional application No. 61/915,675, filed on Dec. 13, 2013.

(51) Int. Cl.
*E04C 5/16* (2006.01)
*E04C 2/34* (2006.01)
*E04C 2/288* (2006.01)

(52) U.S. Cl.
CPC ..... *E04C 5/162* (2013.01); *E04C 2/288* (2013.01); *E04C 2/34* (2013.01)

(58) Field of Classification Search
CPC ..... E04C 2/288; E04C 2/40; E04C 5/162; E04C 5/167
USPC ..... 52/235, 309.11, 378, 379, 426, 703, 52/769, 773, 405.1, 405.4, 435, 678, 684, 52/685, 565, 768, 775, 719, 438, 562; 403/119, 120, 121, 123, 126, 217, 218, 403/219; 248/228.4, 230.4
See application file for complete search history.

(56) References Cited

U.S. PATENT DOCUMENTS

| | | | | | |
|---|---|---|---|---|---|
| 1,053,231 | A | * | 2/1913 | Schweikert | 52/426 |
| 1,088,290 | A | * | 2/1914 | McAllister et al. | 52/699 |
| 1,302,727 | A | * | 5/1919 | Thomas | 52/713 |
| 1,503,148 | A | * | 7/1924 | Bernstrom | 52/365 |
| 1,700,889 | A | * | 2/1929 | Heltzel | 249/4 |
| 1,801,273 | A | * | 4/1931 | Himmel et al. | 52/204.58 |
| 1,975,156 | A | * | 10/1934 | Knight | 52/236.7 |
| 2,178,782 | A | * | 11/1939 | Dunlap | 52/565 |
| 2,400,670 | A | * | 5/1946 | Vander May | 52/506.04 |
| 2,412,253 | A | * | 12/1946 | Diggs | 52/378 |
| 2,765,139 | A | * | 10/1956 | White | 248/228.4 |
| 2,923,146 | A | * | 2/1960 | Mayer | 52/704 |
| 3,018,080 | A | * | 1/1962 | Loudon | 248/228.4 |

(Continued)

OTHER PUBLICATIONS

Search Report and Written Opinion for related PCT Application No. PCT/US2014/067427 filed on Nov. 25, 2014, dated Feb. 20, 2015, 11 pages.

*Primary Examiner* — Rodney Mintz
(74) *Attorney, Agent, or Firm* — Hovey Williams LLP

(57) ABSTRACT

A tie system for an insulated concrete panel. The tie system includes a first structural member formed with a first hub and a pair of first extension members coupled to the first hub. The first extension members extend outwardly from the first hub in generally opposite directions. The tie system further includes a second structural member formed with a second hub and a pair of second extension members coupled to the second hub. The second extension members extend outwardly from the second hub in generally opposite directions. As such, the first and second hubs may be rotatably coupled to one another in a manner that permits rotation of the hubs relative to one another. Thus, the tie system is shiftable between a collapsed configuration and an expanded configuration by rotating the first and second structural members relative to one another.

10 Claims, 14 Drawing Sheets

(56) References Cited

U.S. PATENT DOCUMENTS

| | | | | | |
|---|---|---|---|---|---|
| 3,296,763 | A | * | 1/1967 | Curl | 52/204.64 |
| 3,357,287 | A | * | 12/1967 | Wertepny, Sr. | 81/322 |
| 3,715,850 | A | * | 2/1973 | Chambers | 52/701 |
| 3,832,817 | A | * | 9/1974 | Martens | 52/583.1 |
| 3,925,595 | A | * | 12/1975 | Hawkins | 174/42 |
| 3,940,553 | A | * | 2/1976 | Hawkins | 174/42 |
| 4,027,988 | A | * | 6/1977 | Kum | 403/218 |
| 4,037,978 | A | * | 7/1977 | Connelly | 403/164 |
| 4,059,931 | A | * | 11/1977 | Mongan | 52/79.12 |
| 4,107,890 | A | * | 8/1978 | Seghezzi et al. | 52/379 |
| 4,157,226 | A | * | 6/1979 | Reiter | 403/209 |
| 4,194,851 | A | * | 3/1980 | Littlefield | 403/218 |
| 4,223,176 | A | * | 9/1980 | Hawkins | 174/42 |
| 4,393,635 | A | | 7/1983 | Long | |
| 4,445,308 | A | * | 5/1984 | Taylor | 52/687 |
| 4,471,156 | A | * | 9/1984 | Hawkins | 174/42 |
| 4,637,748 | A | * | 1/1987 | Beavers | 403/170 |
| 4,723,388 | A | * | 2/1988 | Zieg | 52/665 |
| 4,765,109 | A | * | 8/1988 | Boeshart | 52/426 |
| 4,852,324 | A | * | 8/1989 | Page | 52/506.02 |
| 4,904,108 | A | * | 2/1990 | Wendel | 403/173 |
| 4,932,808 | A | * | 6/1990 | Bar et al. | 403/170 |
| 5,154,034 | A | * | 10/1992 | Stanek | 52/766 |
| 5,252,017 | A | * | 10/1993 | Hodel | 411/446 |
| 5,272,850 | A | * | 12/1993 | Mysliwiec et al. | 52/582.2 |
| 5,302,039 | A | * | 4/1994 | Omholt | 403/218 |
| 5,371,991 | A | * | 12/1994 | Bechtel et al. | 52/686 |
| 5,456,048 | A | * | 10/1995 | White | 52/204.61 |
| 5,517,794 | A | * | 5/1996 | Wagner | 52/276 |
| 5,570,552 | A | * | 11/1996 | Nehring | 52/426 |
| 5,628,481 | A | * | 5/1997 | Rinderer | 248/58 |
| 5,673,525 | A | * | 10/1997 | Keith et al. | 52/309.11 |
| 5,899,033 | A | * | 5/1999 | Merchlewitz | 52/204.61 |
| 6,088,985 | A | | 7/2000 | Clark | |
| 6,202,375 | B1 | | 3/2001 | Kleinschmidt | |
| 6,298,549 | B1 | * | 10/2001 | Mangone, Jr. | 29/809 |
| 6,412,242 | B1 | * | 7/2002 | Elmer | 52/235 |
| 6,467,227 | B2 | * | 10/2002 | Elmer | 52/235 |
| 6,519,903 | B1 | * | 2/2003 | Dirisamer et al. | 52/235 |
| 6,606,786 | B2 | * | 8/2003 | Mangone, Jr. | 29/809 |
| 6,675,546 | B2 | * | 1/2004 | Coles | 52/655.1 |
| 6,705,583 | B2 | * | 3/2004 | Daniels et al. | 249/34 |
| 6,761,003 | B2 | * | 7/2004 | Lind | 52/235 |
| 6,761,007 | B2 | | 7/2004 | Lancelot, III et al. | |
| 6,779,241 | B2 | * | 8/2004 | Mangone, Jr. | 29/446 |
| 6,817,156 | B2 | * | 11/2004 | Mok | 52/699 |
| 6,860,454 | B1 | * | 3/2005 | Gronowicz, Jr. | 248/71 |
| 6,915,613 | B2 | * | 7/2005 | Wostal et al. | 52/426 |
| 7,104,718 | B2 | * | 9/2006 | Stoeckler | 403/119 |
| 7,241,071 | B2 | * | 7/2007 | Carraher et al. | 403/164 |
| 7,290,377 | B2 | * | 11/2007 | Dupuis | 52/564 |
| 7,347,029 | B2 | * | 3/2008 | Wostal et al. | 52/426 |
| 7,367,741 | B2 | * | 5/2008 | Vogler | 403/121 |
| 7,469,514 | B2 | * | 12/2008 | Luo | 52/655.1 |
| 7,654,056 | B2 | * | 2/2010 | Luo | 52/655.1 |
| 8,083,432 | B2 | * | 12/2011 | Limpert | 403/389 |
| 8,112,963 | B2 | * | 2/2012 | Johnson | 52/698 |
| 8,215,075 | B2 | * | 7/2012 | Bergman | 52/506.07 |
| 8,312,683 | B2 | | 11/2012 | Tadros et al. | |
| 8,479,469 | B2 | * | 7/2013 | Ciccarelli | 52/426 |
| 8,555,584 | B2 | | 10/2013 | Ciuperca | |
| 8,622,356 | B2 | * | 1/2014 | Lerchner | 248/231.21 |
| 8,720,156 | B2 | * | 5/2014 | Porter | 52/711 |
| 8,839,580 | B2 | * | 9/2014 | Long, Sr. | 52/223.6 |
| 8,840,611 | B2 | * | 9/2014 | Mullaney et al. | 606/59 |
| 2001/0037563 | A1 | * | 11/2001 | Mangone, Jr. | 29/809 |
| 2002/0189178 | A1 | * | 12/2002 | Lind | 52/235 |
| 2003/0208897 | A1 | * | 11/2003 | Mangone, Jr. | 29/453 |
| 2004/0040251 | A1 | * | 3/2004 | Mok | 52/719 |
| 2004/0101352 | A1 | * | 5/2004 | Stoeckler | 403/119 |
| 2004/0103609 | A1 | * | 6/2004 | Wostal et al. | 52/426 |
| 2005/0108963 | A1 | * | 5/2005 | Wostal et al. | 52/426 |
| 2005/0126014 | A1 | * | 6/2005 | Yamin et al. | 30/254 |
| 2005/0217198 | A1 | * | 10/2005 | Carraher et al. | 52/719 |
| 2007/0074478 | A1 | * | 4/2007 | Dupuis | 52/607 |
| 2008/0028709 | A1 | * | 2/2008 | Pontarolo | 52/426 |
| 2008/0240846 | A1 | * | 10/2008 | Phillips | 403/119 |
| 2008/0295425 | A1 | * | 12/2008 | Farag | 52/235 |
| 2009/0067918 | A1 | * | 3/2009 | Luo | 403/122 |
| 2009/0301025 | A1 | * | 12/2009 | Kodi | 52/678 |
| 2009/0324880 | A1 | * | 12/2009 | Johnson | 428/131 |
| 2010/0043337 | A1 | * | 2/2010 | Banks | 52/649.8 |
| 2010/0132290 | A1 | * | 6/2010 | Luburic | 52/309.16 |
| 2011/0265414 | A1 | * | 11/2011 | Ciccarelli | 52/426 |
| 2012/0135200 | A1 | * | 5/2012 | Burvill et al. | 428/174 |
| 2012/0209264 | A1 | * | 8/2012 | Zandona et al. | 606/54 |
| 2012/0285108 | A1 | | 11/2012 | Long, Sr. | |
| 2014/0075882 | A1 | * | 3/2014 | Porter | 52/745.09 |
| 2014/0298743 | A1 | * | 10/2014 | Long, Sr. | 52/405.1 |

* cited by examiner

TIE SYSTEM FOR INSULATED CONCRETE PANELS

RELATED APPLICATION

This non-provisional patent application claims priority benefit, with regard to all common subject matter, of earlier-filed U.S. Provisional Patent Application No. 61/915,675, filed Dec. 13, 2013, and entitled "TIE SYSTEM FOR INSULATED CONCRETE PANELS." The identified earlier-filed provisional patent application is hereby incorporated by reference in its entirety into the present non-provisional application.

FIELD OF THE INVENTION

Embodiments of the present invention are direct generally to a new tie system and method for making insulated concrete panels. More specifically, embodiments of the present invention are directed to using the new tie system to more effectively and efficiently manufacture improved insulated concrete panels.

BACKGROUND OF THE INVENTION

Insulated concrete panels are well known in the construction industry. Such concrete panels are generally formed with insulation layers sandwiched between top and bottom concrete layers. To secure the concrete layers to the insulation layers, connectors (otherwise known as "ties") may be used. The ties will connect the two concrete layers together through the insulation layer. As such, the ties hold the components of the insulated concrete panels together and also provide a mechanism whereby loads can be transferred between the concrete layers.

Depending on the application, the ties may be formed in various shapes and from various materials. In the past, metals, such as iron or steel, have been used to form such ties. However, metals are high thermal conductors and, as such, permit undesirable thermal conduction through the concrete layers. Furthermore, the insulation layer that receives such ties will usually be formed with holes for receiving the ties. Often, such holes are formed much larger than the ties themselves. Such a mismatch between the size of the ties and the holes further decreases the thermal efficiency of the concrete wall panels.

Based on design considerations, the size (e.g., the thickness) of the insulation layers used in the insulated concrete panels may vary widely. For example, construction of a single building may require a plurality of different types of insulated concrete panels to be used, with each panel having a different insulation layer size. In more detail, a building may require that its exterior walls be constructed from insulated concrete panels having a very thick insulation layer, so as to reduce heat transfer to/from the ambient. Contrastingly, the building may have interior walls that are required to be constructed from insulated concrete panels having an insulation layer with a reduced thickness. Such an insulation layer with a reduced thickness may be used because the interior walls may not need to restrict heat transfer as much as the exterior walls. However, incorporating insulated concrete panels with insulation layers having varying sizes necessarily requires the use of ties of varying sizes. Specifically, thicker insulation layers require the use of larger ties, while thinner insulation layers require the use of smaller ties. The need to use varying sizes of ties can increase the complexity and decrease the efficiency of construction processes in building projects.

Accordingly, there is a need in the industry for a tie for an insulated concrete panel that provides the necessary strength for building applications, while at the same time, provides enhanced thermal insulation. Furthermore, there is a need for a single tie that is capable of being used with insulated concrete panels having insulation layers of various sizes.

SUMMARY OF THE INVENTION

In one embodiment of the present invention, there is provided a tie system for an insulated concrete panel. The tie system comprises a first structural member including a first hub and a pair of first extension members coupled to the first hub, with the first extension members extending outwardly from the first hub in generally opposite directions. The tie system further comprises a second structural member including a second hub and a pair of second extension members coupled to the second hub, with the second extension members extending outwardly from the second hub in generally opposite directions. As such, the first and second hubs are configured to be rotatably coupled to one another in a manner that permits rotation of the first and second hubs relative to one another on an axis of rotation extending through the first and second hubs. Furthermore, when the first and second hubs are rotatably coupled to one another the tie system is shiftable between a collapsed configuration and an expanded configuration by rotating the first and second structural members relative to one another on the axis of rotation.

In another embodiment of the present invention, there is provided an insulated concrete panel comprising an insulation layer with a tie opening extending therethrough, first and second concrete layers disposed on generally opposite sides of the insulation layer, and a tie system. The tie system comprises a hub portion at least partly receive in the tie opening, a first end section at least partly embedded in the first concrete layer, and a second end section at least partly embedded in the second concrete layer. The tie system is capable of shifting from a collapsed configuration, in which a maximum width of the first and second end sections is less than a maximum width of the tie opening, to an expanded configuration, in which the maximum width of the first and second end sections is greater than the maximum width of the tie opening.

In yet another embodiment of the present invention, there is provided a method of making an insulated concrete panel. The method includes an initial step of creating a tie opening that extends through an insulation layer. A next step includes inserting an expandable tie system into the tie opening. Thereafter, while the tie system is received in the tie opening and with opposite end sections of the tie system extending out of the tie opening, a next step includes shifting the tie system into an expanded configuration where a maximum width of the tie system is greater than a maximum width of the tie opening. Finally, while the tie system is in the expanded configuration, a layer of concrete is formed on each side of the insulation layer so that opposite end sections of the tie system are embedded in the opposite layers of concrete, thereby physically coupling the layers of concrete to one another using the tie system.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE FIGURES

Embodiments of the present invention are described herein with reference to the following drawing figures, wherein.

Figure 1:
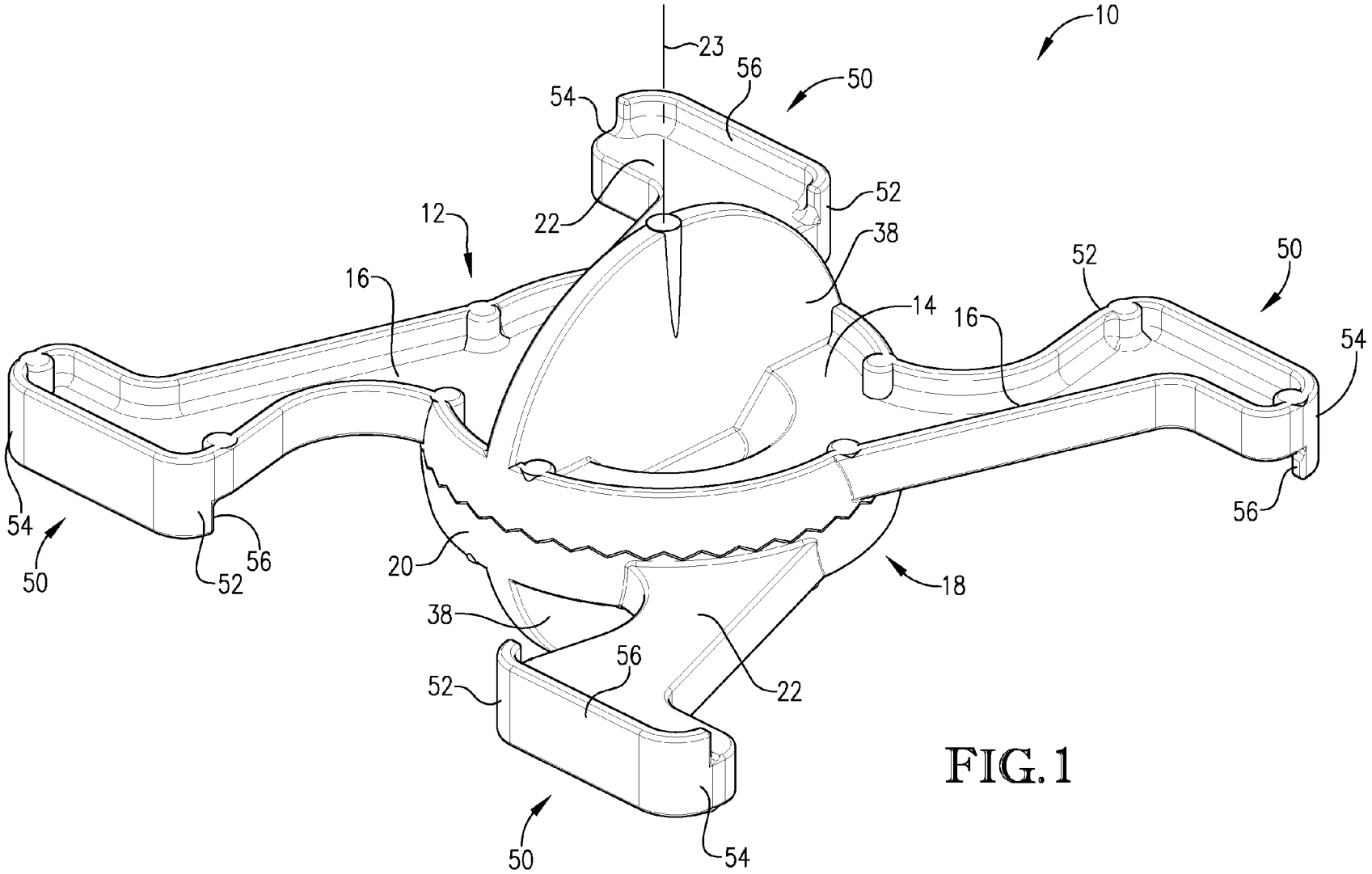
FIG. 1 is top perspective view of a tie system in an assembled configuration according to embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the present invention references various embodiments. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 14:
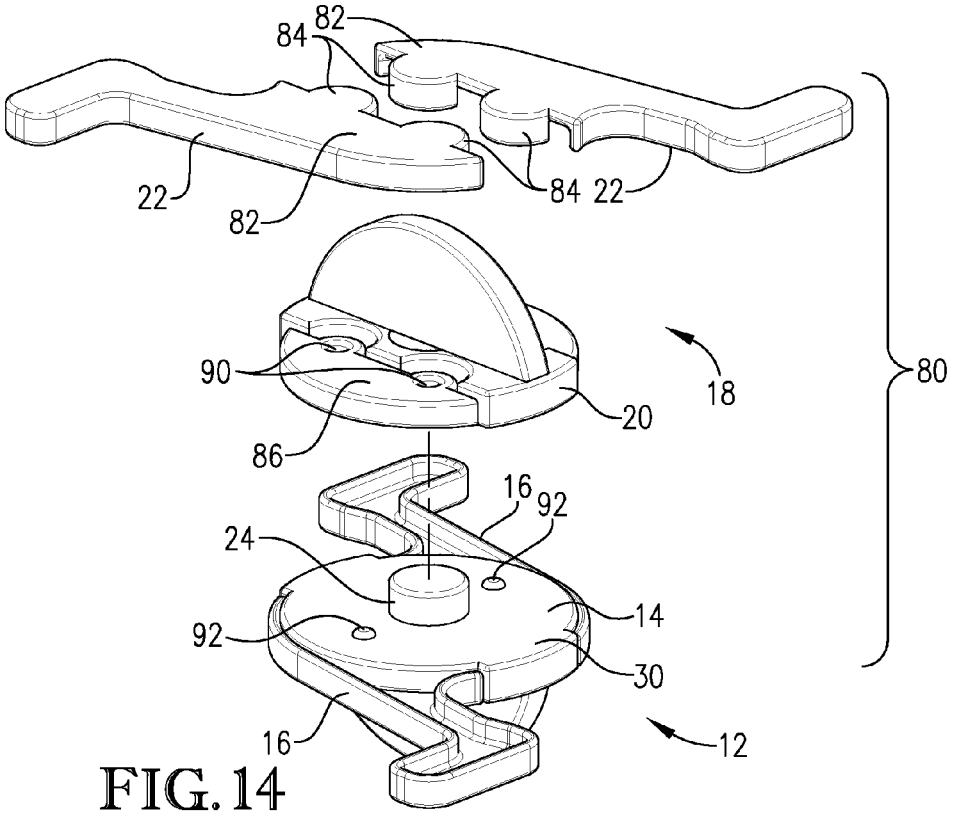
FIG. 14 is a bottom exploded view of an additional embodiment of a tie system in a disassembled configuration according to embodiments of the present invention, with the tie system having extension members and hubs, and with the extension members being separable from the hubs.
Figure 15:
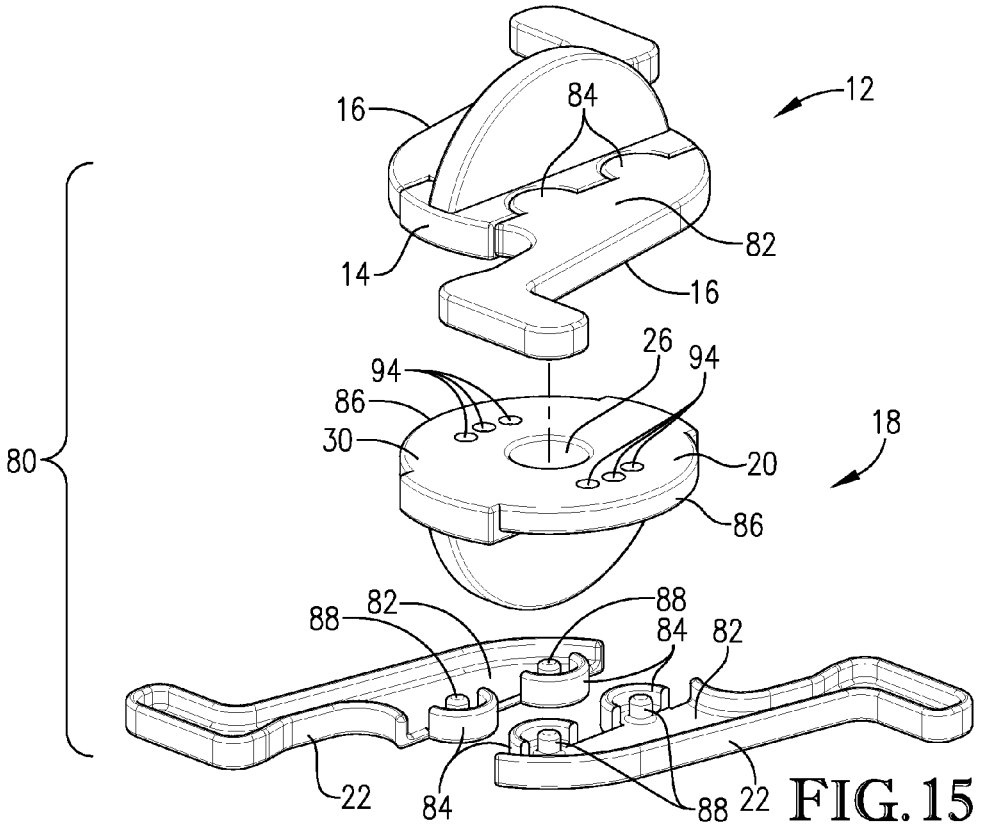
FIG. 15 is top exploded view of the tie system of FIG. 14 in a disassembled configuration.

As will be described in more detail below, FIGS. 1-12 show an embodiment of the invention where structural members of a tie system are integrally formed of a single material having a low thermal conductivity, such as non-metallic composite material. Alternatively, FIGS. 14-15 show an embodiment of the invention where structural members of a tie system are formed of two different materials, such as a first material having a high thermal conductivity (e.g., steel) and a second material having a low thermal conductivity (e.g., a non-metallic composite material). The single-material tie system of FIG. 1-12 will be described first, followed by a description of the multi-material tie system of FIGS. 14-15.

Nevertheless, in this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Single-Material Tie System

Figure 2:
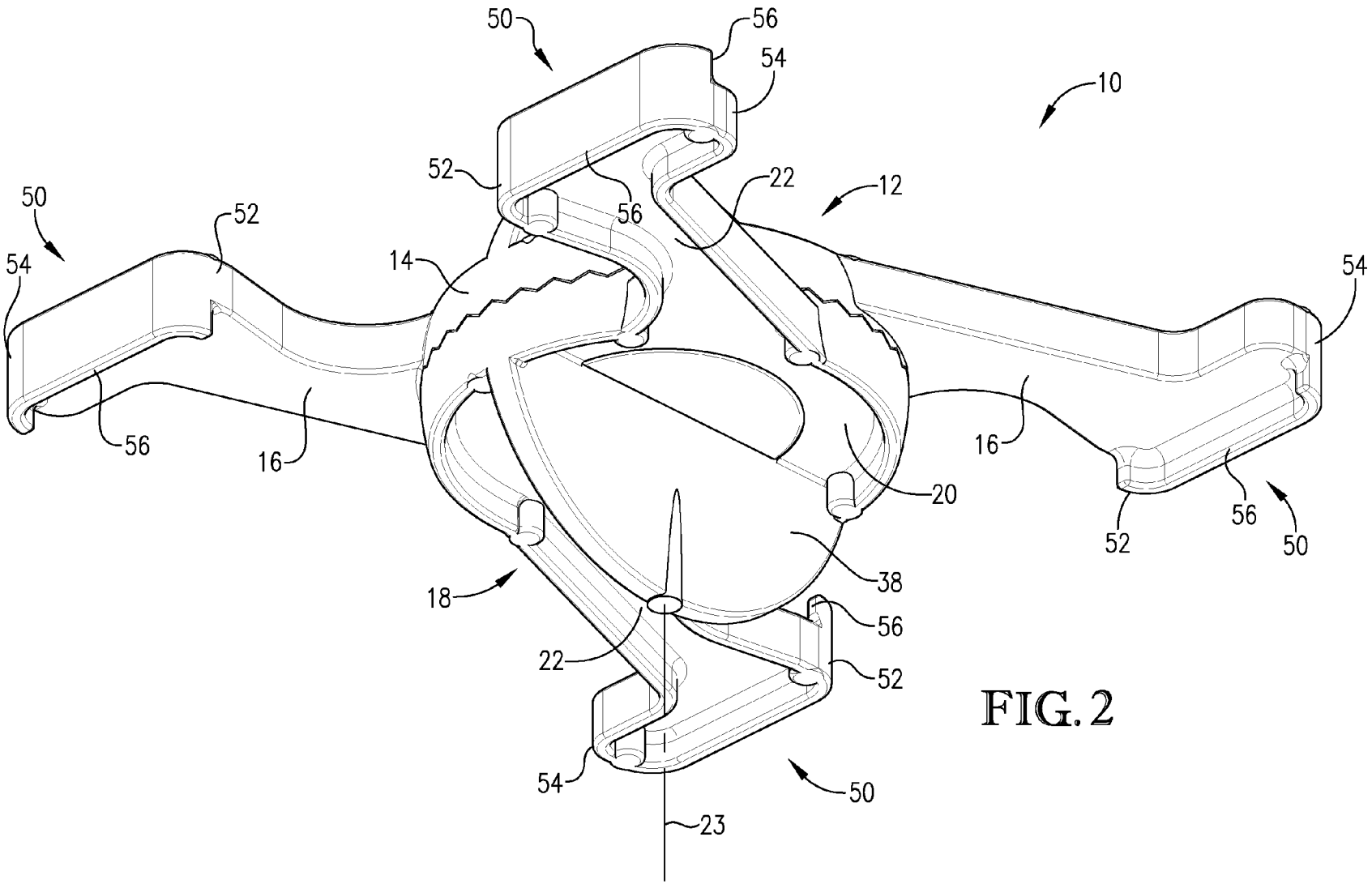
FIG. 2 is bottom perspective view of the tie system of FIG. 1 in the assembled configuration.
Figure 3:
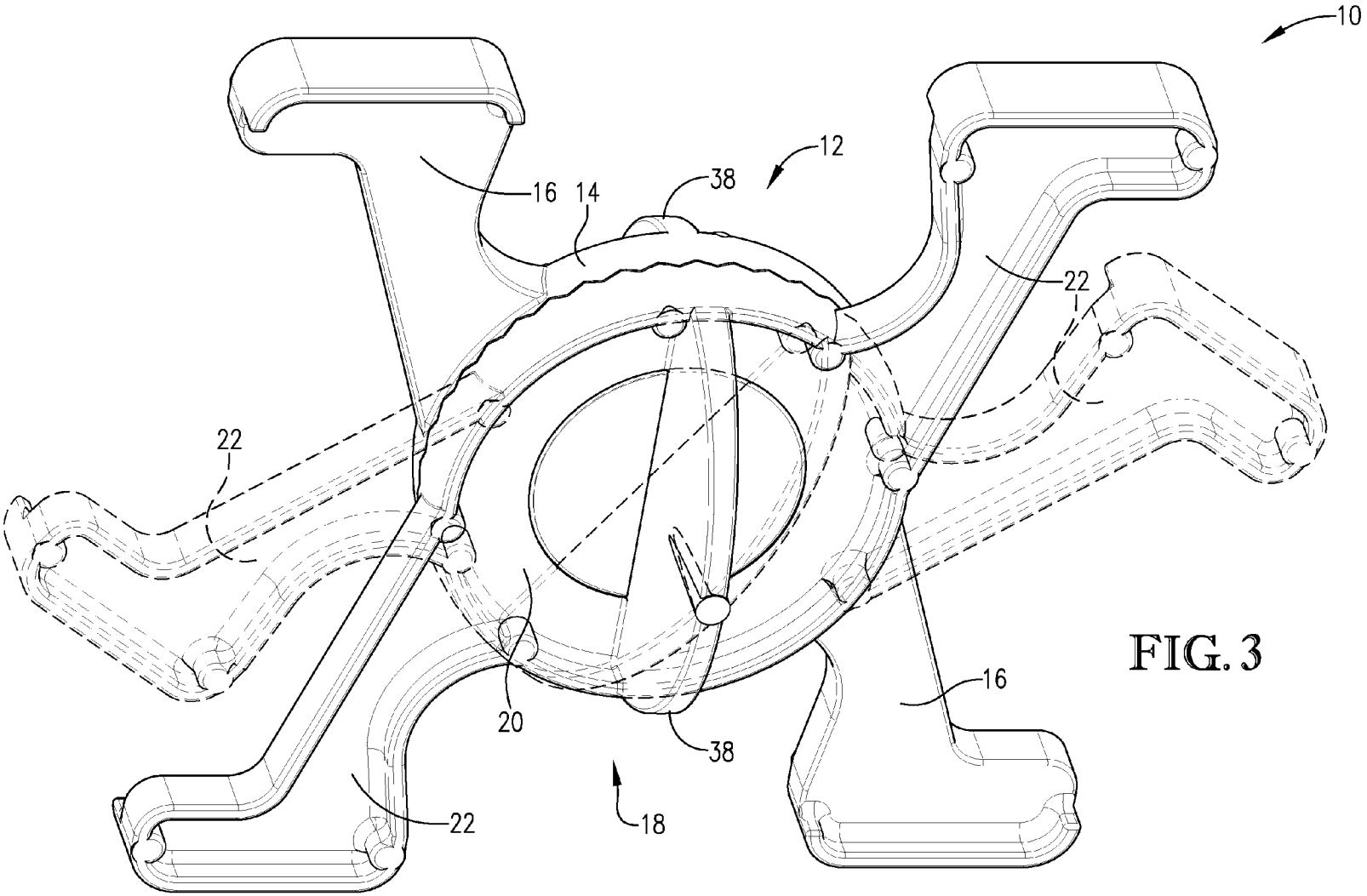
FIG. 3 is a bottom perspective view of the tie system of FIGS. 1-2 in the assembled configuration and having a first structural member and a second structural member, with the tie system being shown in a first and second rotational position, and with the second structural member being shown in dashed-line in the second rotational position.
Figure 4:
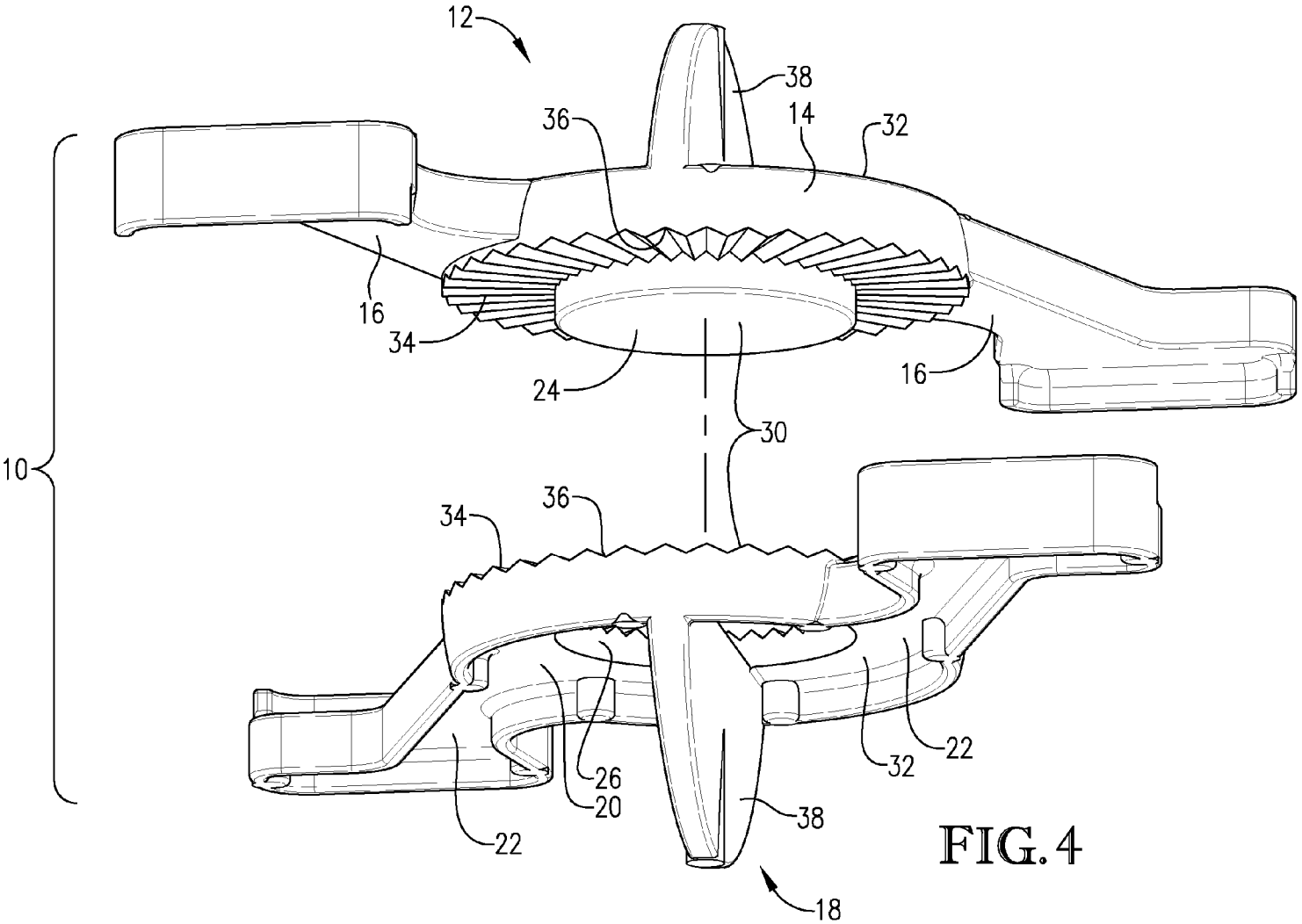
FIG. 4 is a side perspective view of the tie system of FIGS. 1-3 in a disassembled configuration.
Figure 5:
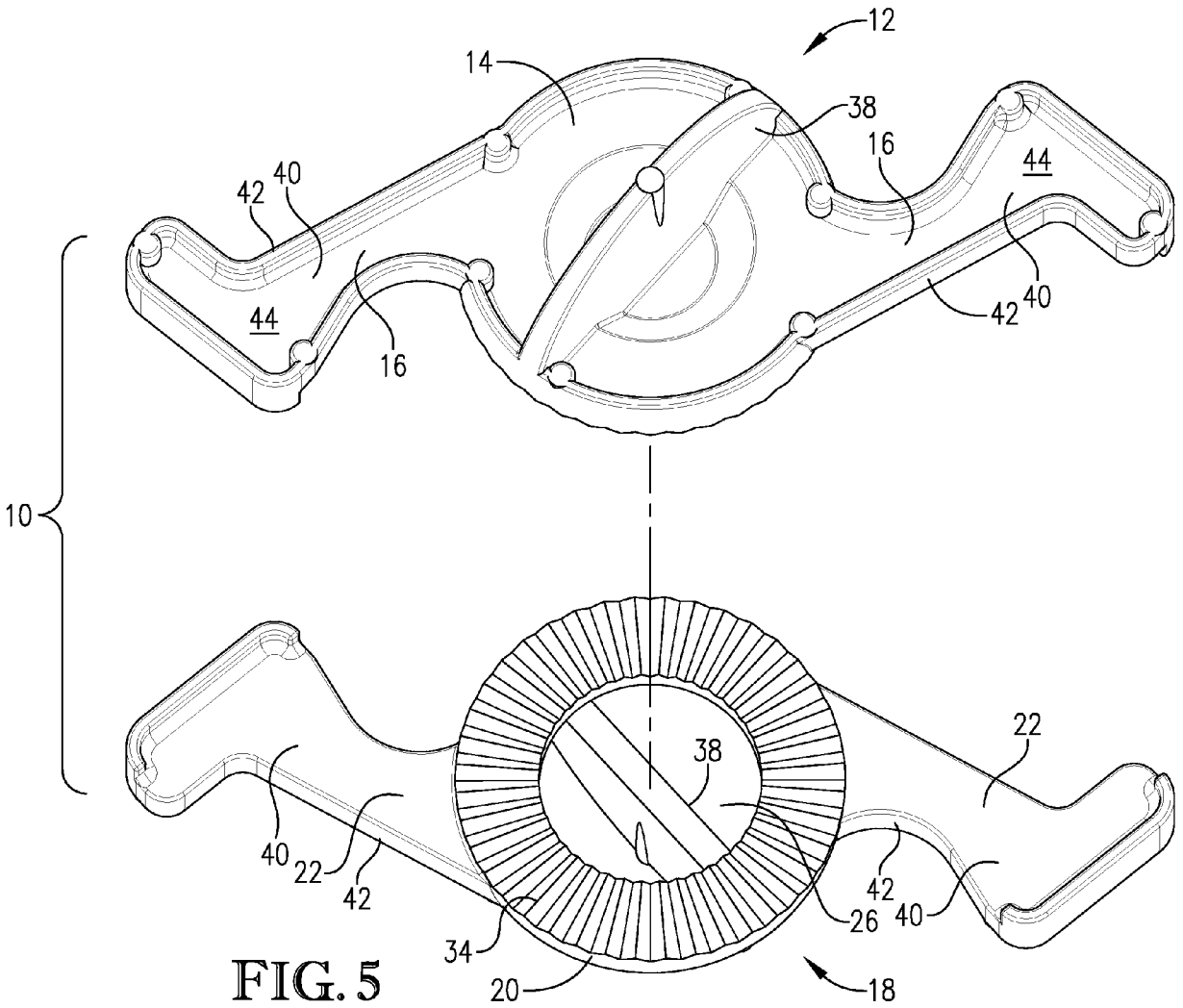
FIG. 5 is a top perspective view of the tie system of FIGS. 1-4 in a disassembled configuration.
Figure 6:
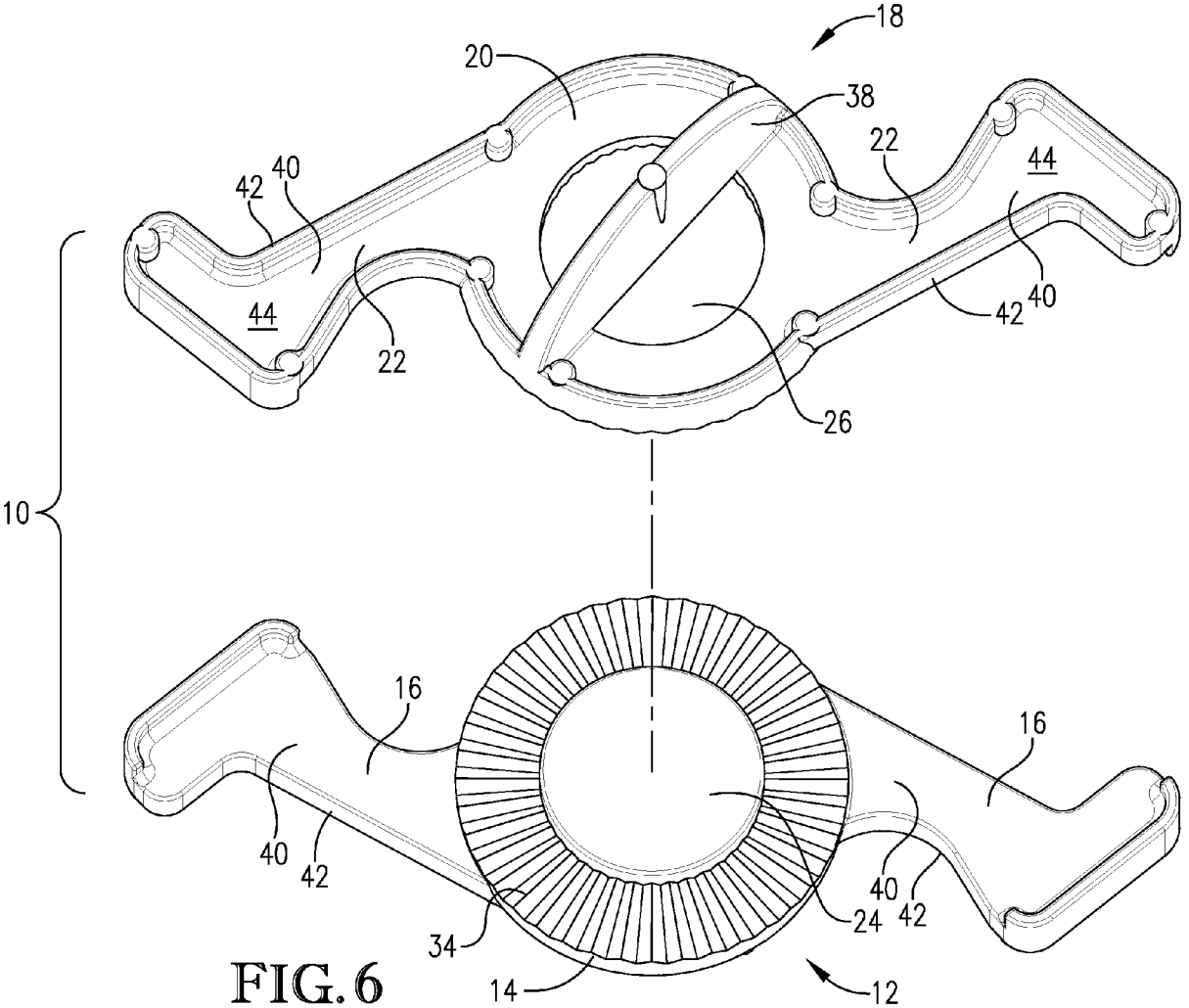
FIG. 6 is a bottom perspective view of the tie system of FIGS. 1-5 in a disassembled configuration.

With reference to FIGS. 1-6, embodiments of the present invention include a tie system 10 for use in forming an insulated concrete panel. The tie system 10 includes a first structural member 12 comprising a first hub 14 and a pair of first extension members 16 coupled to said first hub 14, such that the first extension members 16 extend outwardly from the first hub 14 in generally opposite directions. The tie system 10 further includes a second structural member 18 comprising a second hub 20 and a pair of second extension members 22 coupled to the second hub 20, such that the second extension members 22 extend outwardly from the second hub 20 in generally opposite directions. The first and second hubs 14, 20 are configured to be rotatably coupled to one other (when coupled together the hubs 14, 20 may define a hub portion) in a manner that permits rotation of the first and second structural members 12, 18 relative to one another about an axis of rotation 23 (See FIGS. 1-2) extending through the first and second hubs 14, 20. In more detail, as illustrated by FIGS. 4-6, the hub 14 of the first structural member 12 may be equipped with a hub projection 24, and the hub 20 of the second structural member 18 may be equipped with a hub recess 26. Embodiments provide for the hub projection 24 to be received within the hub recess 26 so as to rotatably couple the first and second structural members 12, 18 together. Such a configuration provides for the tie system 10 to be capable of shifting between a collapsed configuration and an expanded configuration (as will be discussed in more detail below) by rotating the first and second structural members 12, 18 relative to one another about the axis of rotation 23.

The tie system 10, as described above, is further operable to be configured in an assembled and disassembled configuration. In FIGS. 1-3, the tie system 10 is shown in the assembled configuration, where the first and second structural members 12, 18 are rotatably coupled to one another in a scissor-like configuration. As illustrated in FIG. 3, when the tie system 10 is assembled, the first and second structural members 12, 18 can rotate relative to one another on an axis of rotation that extends through the coupled first and second hubs 14, 20. This manner of rotatably coupling the first and second structural members 12, 18 gives the tie system 10 the scissor-like configuration. As used herein, the term "scissor-like configuration" means a configuration of two elongated components, where the elongated components are rotatably coupled to one another at a connection location that is spaced from ends of both the elongated components, so that expansion or contraction of the ends of the components on one side of the connection location causes corresponding expansion or contraction of the ends of the components on the other side of the connection location. FIGS. 4-6 show the tie system 10 in a disassembled configuration, where the first and second structural members 12, 18 are not coupled to one another.

As illustrated in the drawings, certain embodiments provide for the first and second structural members 12, 18 to each have substantially the same shape. Furthermore, each of the first and second structural members 12, 18 may be substantially symmetrical about the axis of rotation 23. In some embodiments, the first and second structural members 12, 18 may each have a length of between 3 to 18 inches, between 4 to 15 inches, between 5 to 12 inches, or between 6 to 9 inches. Additionally, in some embodiments, the first and second structural members 12, 18 may each have a width of between 1 to 6 inches, between 2 to 5 inches, or between 3 to 4 inches. Finally, in some embodiments the hubs 14, 20 will have a width (e.g., an outer diameter) of between 1 to 12 inches, between 2 to 6 inches, between 2.5 to 4 inches, or between 2.75 to 3.25 inches.

As best illustrated in FIG. 4, each of the first and second structural members 12, 18 of the tie system 10 presents an inwardly-facing side 30 and an outwardly-facing side 32, with the inwardly and outwardly-facing sides 30, 32 of each structural member 12, 18 facing an opposite direction. In the assembled configuration of FIGS. 1-3, such as when said first and second hubs 14, 20 are rotatably coupled to one another, the inwardly-facing sides 30 of the first and second structural members 12, 18 engage one another.

Returning to FIGS. 4-6, the hub 14 of the first structural member 12 may be formed with the hub projection 24 and the hub 20 of the second structural member 18 may be formed with the hub recess 26. The hub projection 24 may extend from a portion of the inwardly-facing side 30 of the first structural member 12. In some embodiments, the hub projection 24 may form at least a portion of the inwardly-facing side 30 of the first structural member 12. Contrastingly, the hub recess 26 penetrates within the second hub 20 from the inwardly-facing side 30 of the second structural member 18. In some embodiments, the hub recess 26 extends through an entire width of the second hub 20, such that the hub recess 26 presents an opening through the second hub 20. Embodiments provide for the hub projection 24 and the hub recess 26 to be complementary sized, such that the hub projection 24 can be received within the hub recess 26 in the assembled configuration, such as shown in FIGS. 1-3. For example, in some embodiments, the hub projection 24 has a cross-sectional area of 0.1, 0.25, 0.5, 0.75, 1, or more square inches. Similarly, the hub recess 26 may present a cross-sectional open area of at least 0.1, 0.25, 0.5, 0.75, 1, or more square inches. As such, the tie system 10 can be assembled by inserting the hub projection 24 into the hub recess 26. In such an assembled configuration, the receipt of the hub projection 24 in the hub recess 26 inhibits translation of the first and second structural members 12, 18, while permitting rotation of the first and second structural members 12, 18 relative to one another on the axis of rotation 23.

As best illustrated in FIGS. 4-6, embodiments of the present invention further provide for each of the first and second structural members 12, 18 to include a plurality of radially-extending ribs 34 extending about at least a portion of the inwardly-facing sides 30 of the members' hubs 14, 20. With particular reference to FIG. 4, each of the ribs 34 is separated by a gap 36. In the assembled configuration, such as when said first and second hubs 14, 20 are rotatably coupled to one another, the ribs 34 of the first structural member 12 are configured to engage within the gaps 36 of the second structural member 18, and the ribs 34 of the second structural member 18 are configured to engage within the gaps 36 of the first structural member 12. As such, the ribs 34 and gaps 36 are configured engage with each other so as to hold the first and second structural members 12, 18 relative to one another in a plurality of different rotational positions. As such, the first and second structural members 12, 18 may be "locked" in various relative rotational positions. Such a configuration provides for a single tie system 10 to be used with insulation layers of varying sizes (e.g., varying thicknesses). It is understood that a greater number of ribs 34 facilitates the first and second structural members 12, 18 to be held in a correspondingly greater number of different rotational positions. Certain embodiments may provide for each of the first and second structural members 12, 18 to include between 10 and 200 ribs 34, between 20 and 100 ribs 34, or between 40 and 60 ribs 34. As will be discussed in more detail below, in addition to the ribs 34 and gaps 36, certain embodiments will provide for the first and second structural members 12, 18 to be held in a plurality of different rotational positions via positioning nubs and corresponding positioning notches.

As shown in FIGS. 1-6, each of the first and second hubs 14, 20 includes a barrier 38 extending generally perpendicularly from a portion of the hubs' outwardly-facing sides 32. In some embodiments, the barriers 38 may present a rounded outer profile that forms at least a portion of the outwardly-facing sides 32. The barriers 38 may each comprise a substantially planar member having two substantially flat sides. As such, the barriers 38 may each have the general shape of a half disk. In other embodiments, the barriers 38 may each have the general shape of a half sphere.

In some embodiments, as best illustrated in FIGS. 5-6, the first and second extension members 16, 22 will each comprise a main sidewall 40 and a perimeter wall 42. The perimeter sidewalls 42 may extend away from the outwardly-facing sides 32 of their respective extension member 16, 22. Furthermore, in some embodiments, the perimeter sidewalls 40 may be generally perpendicular to their respective main sidewall 40. As such, the main sidewall 40 and perimeter sidewall 42 of each of the first and second extension members 16, 22 present an open void 44 bounded by the sidewalls 40, 42.

As shown in FIGS. 1-2, embodiments further provide for the first and second extension members 16, 22 to each comprise an enlarged end portion 50, with the end portions 50 including oppositely facing heel portions 52 and toe portions 54. In some embodiments, the end portions 50 will include an end wall 56 that extends from the inwardly-facing side 30 of the first and second extension members 16, 22. The end walls 56 of each of the first and second extension members 16, 22 are configured to facilitate receipt of concrete when portions of the first and second extension members 16, 22 are embedded in concrete (as discussed in more detail below), so as to prevent pullout of the tie system 10 from the concrete. In other embodiments (not shown in the figures), each end portion 50 may further comprise a holding aperture extending through a thickness of the end portion 50. As such, the holding apertures may be configured to receive concrete when the end portions 50 are embedded in concrete, so as to prevent pullout of the tie system 10 from the concrete.

Turning to FIG. 3, the tie system 10, as described above, is capable of being held in a plurality of different rotational positions. For example, FIG. 3 illustrates the tie system 10 in an expanded configuration, i.e., with both the first and second structural members 12, 18 in solid-line. Alternatively, FIG. 3 also illustrates the tie system 10 in a partially-collapsed configuration, i.e., with the first structural member 12 in solid line and the second structural member 18 in dashed-line. As will be discussed in more detail below, in a collapsed configuration, the tie system 10 can be inserted into an opening formed in an insulation layer used in an insulated concrete panel. After the tie system 10 has been inserted in the opening of the insulation layer, the tie system can be transitioned to the expanded configuration where concrete can be poured about the tie system 10 and the insulation layer for manufacturing the insulated concrete panel.

The first and second structural members 12, 18 of the tie system 10 can be supplied to an insulated concrete panel maker (e.g., a "pre-caster") in the disassembled configuration (i.e., with the first and second structural members 12, 18 decoupled from one another). In general, a plurality of the tie systems 10 can used by the panel maker to rigidly connect two layers of concrete that have an insulation layer, such as an expanded or extruded polystyrene board, positioned between the concrete layers. In other embodiments, insulation layers can be formed from expanded polystyrene, polyisocyanurate, expanded polyethylene, extruded polyethylene, or expanded polypropylene. To initiate manufacture of the insulated concrete panel, the panel maker can select the unassembled first structural member 12 and the second structural member 18 and then connect them to one another, as previously described, by inserting the hub projection 24 of the first structural member 12 into the hub recess 26 of the second structural member 18.

Figure 7:
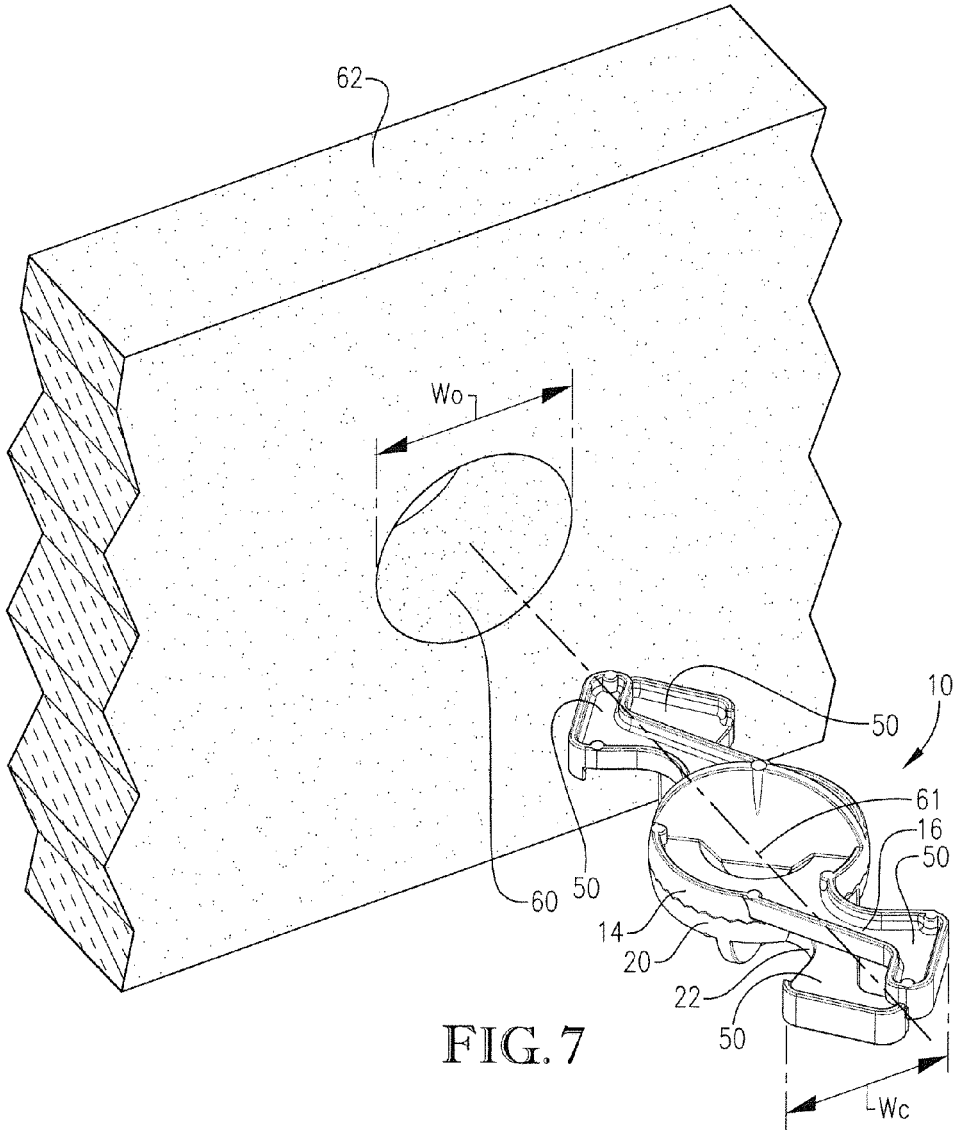
FIG. 7 is an illustration of the tie system of FIGS. 1-6 in a collapsed configuration and prepared for insertion into a tie opening of an insulation layer.
Figure 8:
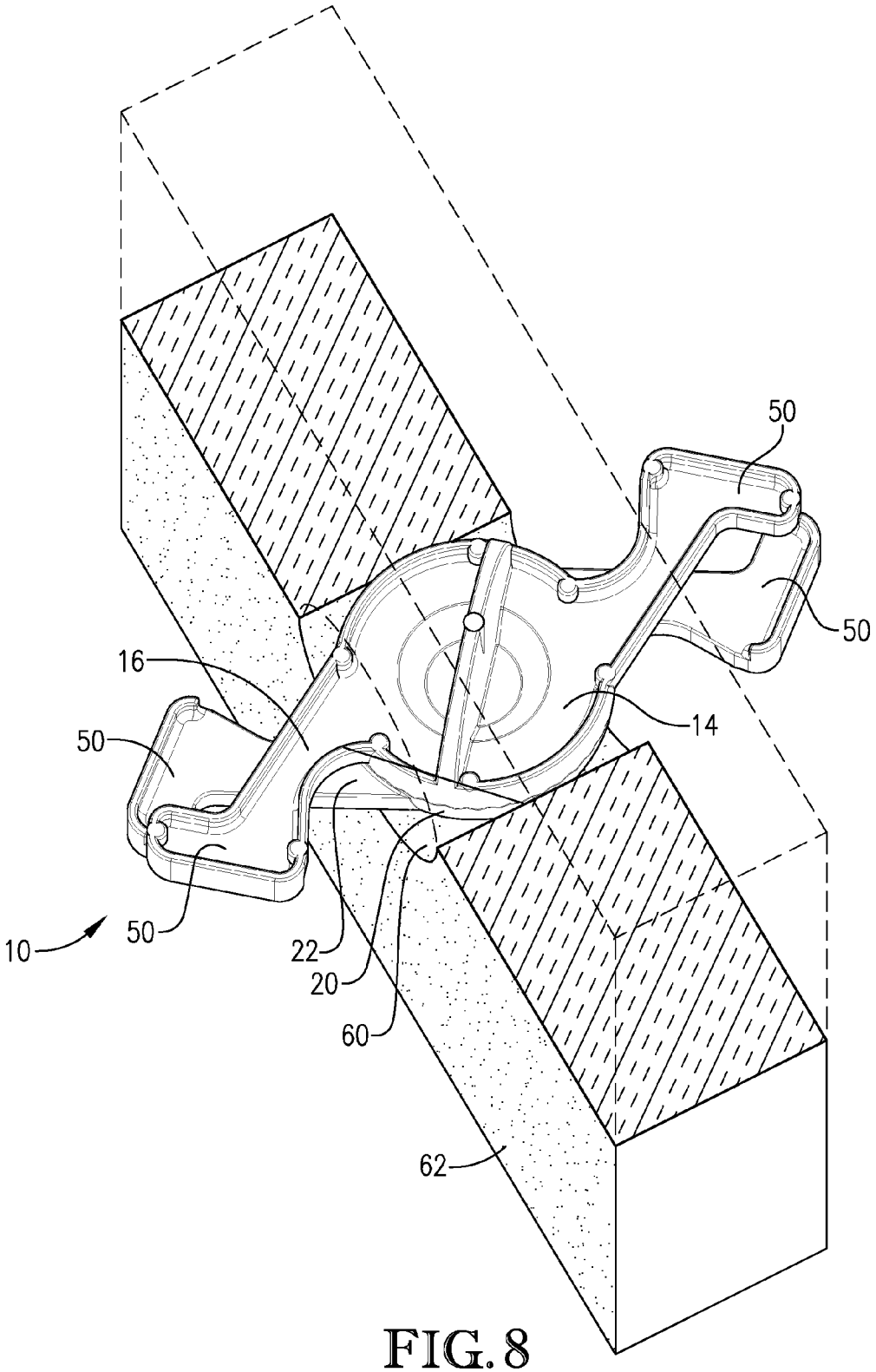
FIG. 8 is an illustration of the tie system of FIGS. 1-6 in a collapsed configuration and inserted into the tie opening of the insulation layer from FIG. 7, with a portion of the insulation layer removed at a horizontal cross-section for clarity.

As illustrated by FIG. 7, once the tie system 10 is assembled, it can be prepared for insertion into a tie opening 60 that has been formed in an insulation layer 62 (e.g., a panel or a board) so as to manufacture an insulated concrete panel. The tie opening 60 may be substantially cylindrical and may be formed using a hand drill and a core bit. However, embodiments may provide for the tie opening 60 to have other shapes and to be formed from other methods. Prior to insertion into the tie opening 60, the tie system 10 is shifted into a collapsed configuration, where a width Wc between adjacent end portions 50 of each of the first and second extensions members 16, 22 is minimized to be less than a width Wo of the tie opening 60 and/or less than a width of the hubs 14, 20 of the structural members 12, 18. As best illustrated by FIGS. 7-9, when the tie system 10 is in the collapsed configuration, its length (measured along an axis of elongation 61) is maximized and its width is minimized so that it can then be inserted into tie opening 60 of the insulation layer 62 until the hubs 14, 20 of the tie system are substantially centered in the tie opening 60.

Figure 10:
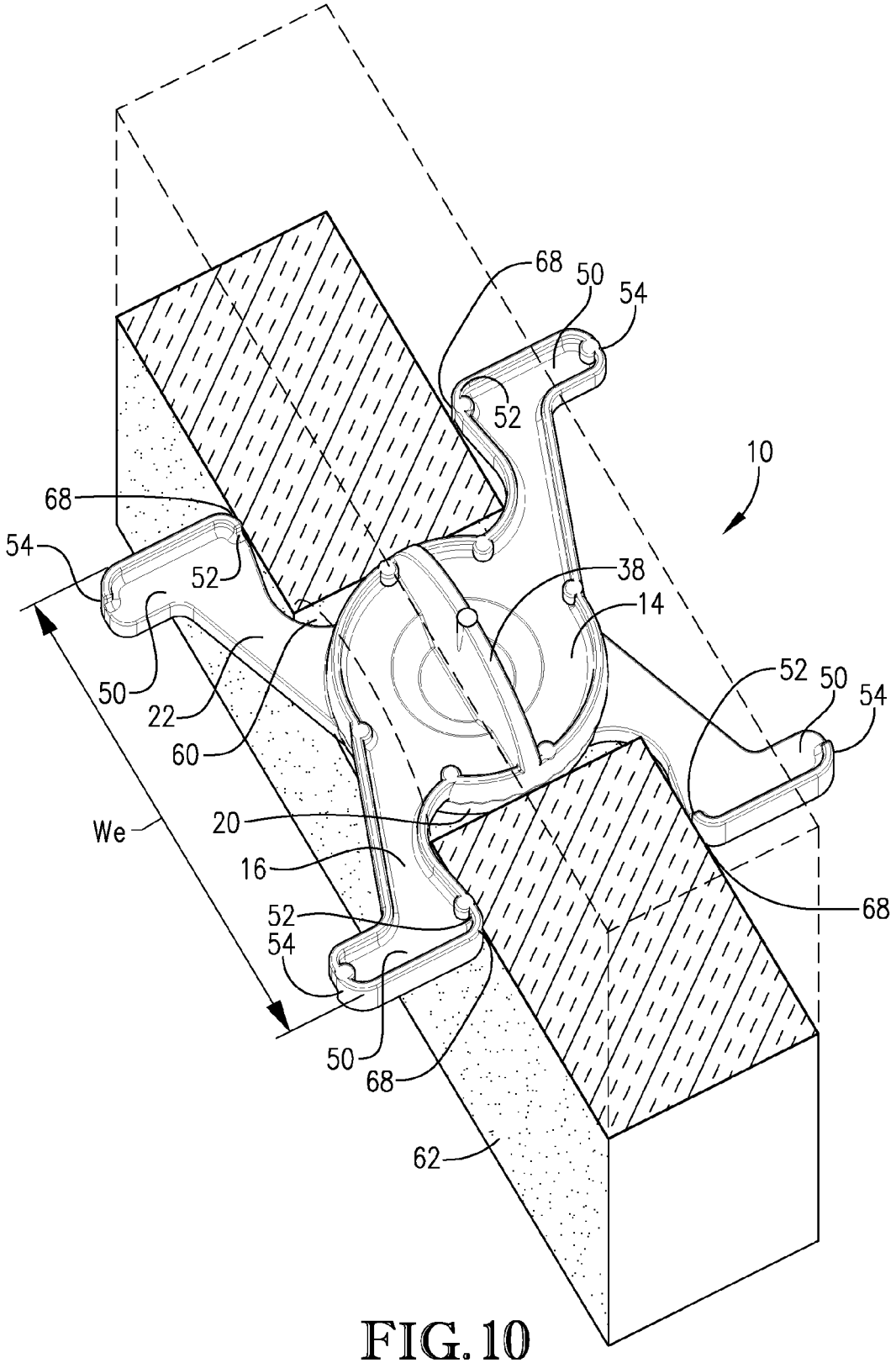
FIG. 10 is an illustration of the tie system of FIGS. 1-6 in an expanded configuration and inserted into the tie opening of the insulation layer from FIGS. 7-9, with a portion of the insulation layer removed at a horizontal cross-section for clarity.
Figure 11:
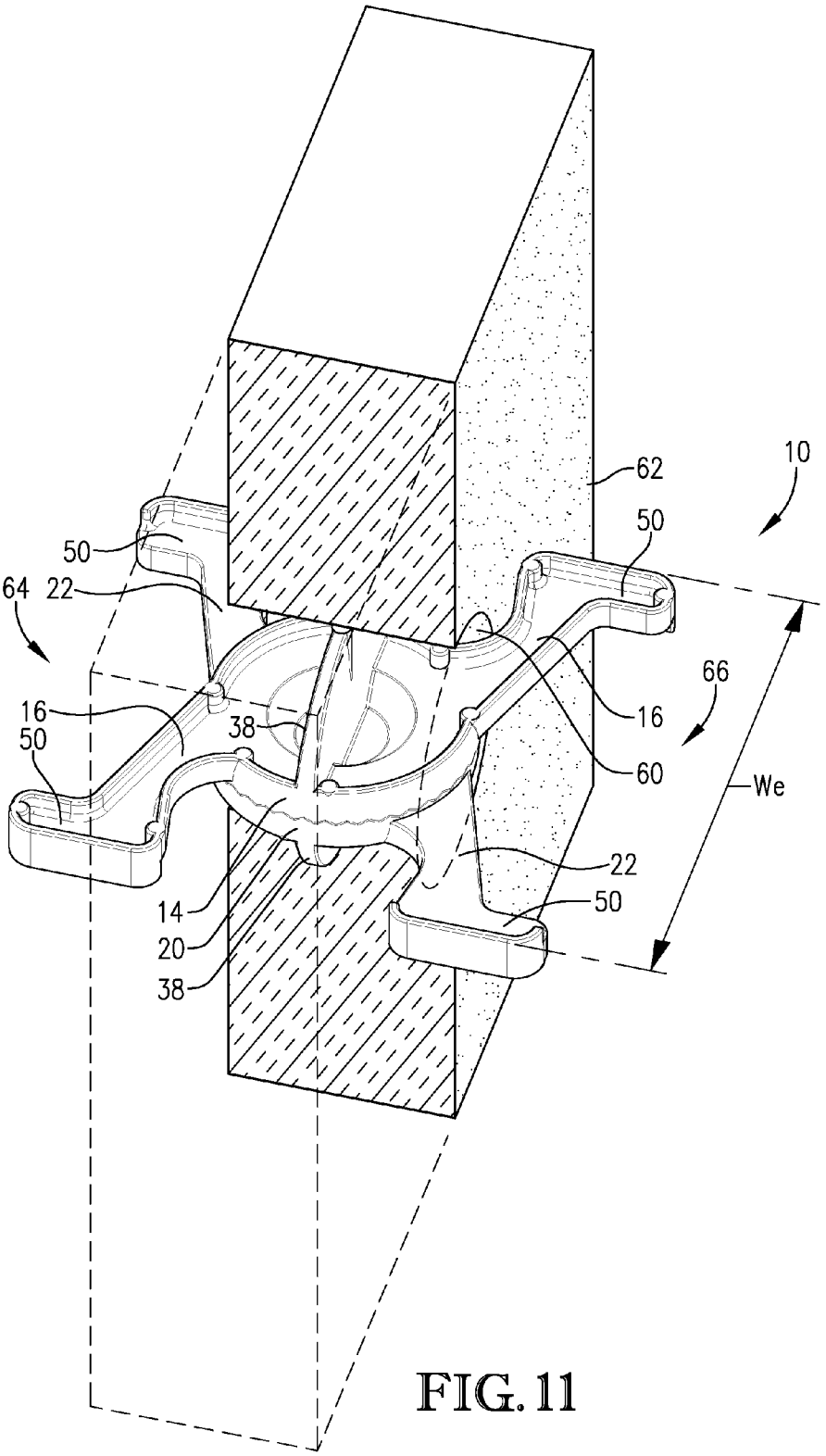
FIG. 11 is an additional illustration of the tie system of FIGS. 1-6 in an expanded configuration and inserted into the tie opening of the insulation layer from FIGS. 7-10, with a portion of the insulation layer removed at a vertical cross-section for clarity.

As illustrated by FIGS. 10-11, once the hubs 14, 20 of the tie system 10 are received in the tie opening 60, the tie system 10 can be shifted into the expanded configuration. As shown in FIG. 10, in the expanded configuration, a width We between the adjacent end portions 50 of each of the first and second extension members 16, 22 is maximized to be greater than the width Wo of the tie opening 60 (see FIG. 7) and/or greater than the width of the hubs 14, 20. In certain embodiments, a ratio of We to Wc of the tie system 10 is at least 1.2:1, 1.5:1, 2:1, or 3:1. As such, shifting of the tie system 10 from the collapsed configuration to the expanded configuration increases a maximum width of the tie system 10 and decreases a maximum length of the tie system 10. As such, when the tie system 10 is in the collapsed configuration a maximum width of the tie system 10 is less than a maximum width of the first and second hubs 14, 20 and the tie opening 60, and when the tie system 10 is in the expanded configuration the maximum width of the tie system 10 is greater than the maximum width of the first and second hubs 14, 20 and the tie opening 60.

Figure 9:
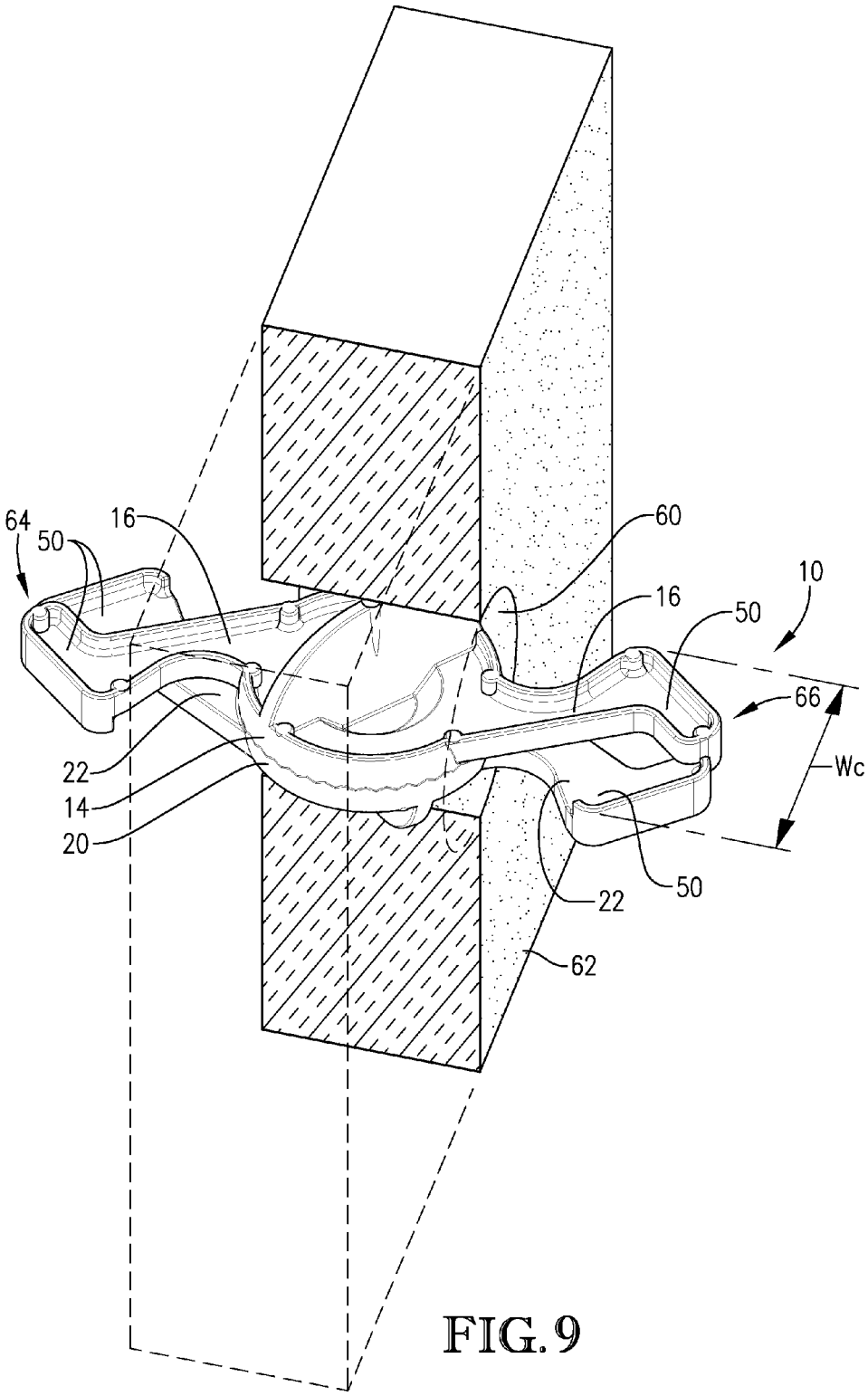
FIG. 9 is an additional illustration of the tie system of FIGS. 1-6 in a collapsed configuration and inserted into the tie opening of the insulation layer from FIGS. 7-8, with a portion of the insulation layer removed at a vertical cross-section for clarity.

As best illustrated in FIGS. 9 and 11, in certain embodiments, the tie system 10 may be described as having first and second end sections 64, 66. The first end section 64 may comprise one of the end portions 50 of the first extension member 16 and the adjacent end portion 50 of the second extension member 22. Similarly, the second end section 66 may comprise the other end portion 50 of the first extension member 16 and the adjacent end portion 50 of the second extension members 22. Given such definitions, the width of the first and second end sections 64, 66 are defined as the width Wc when the tie system is in the collapsed configuration, and the width of the first and second end sections 64, 66 are defined as the width We when the tie system 10 is in the expanded position. As such and in the expanded configuration, maximum widths of the first and second end sections 64, 66 are each greater than the maximum width of the tie opening 60, and in the collapsed configuration, maximum widths of the first and second end sections 64, 66 are each less than the maximum width of the tie opening 60.

As illustrated in FIG. 10, in the expanded configuration, the end portions 50 of the extension members 16, 22 engage the insulation layer 62 in four contact locations 68 located outside of, but proximate to, the tie opening 60. Two of these contact locations 68 are on one side of the insulation layer 62 and the other two of the contact locations 68 are on the opposite side of the insulation layer 62. As previously described, the end portions 50 of each extension member 16, 22 are enlarged relative intermediate portions of the extension members 16, 22. Such an enlargement provides for the heel 52 to engage a surface of the insulation layer 62 and the toe 54 to extend outwardly from the surface of the insulation layer 62.

In certain embodiments, as shown in FIGS. 10-11, the rounded outer profiles of the barriers 38 of each of the hubs 14, 20 substantially conform to a cross-sectional shape of the tie opening 60. When the tie system 10 is received in the tie opening 60 and placed in the expanded configuration, the hubs 14, 20, including the barriers 38, fill up a substantial portion of the cross-sectional area of the tie opening 60. Such filling up being due, in part, to the barriers 38 of the first and second hubs 14, 20 being more closely aligned with one another when the tie system 10 is in said expanded configuration (i.e., FIGS. 10-11) than when the tie system 10 is in said collapsed configuration (i.e., FIGS. 8-9). In certain embodiments, the hubs 14, 20, including the barriers 38, fill at least 70%, 80%, 90%, or 100% of the cross-sectional area of the tie opening 60 when the tie system 10 is in the expanded configuration. By filling up a substantial portion of the cross-section area of the tie opening 60, the barriers 38 are configure to thermally isolate layers of concrete that will be placed on opposite sides of the insulation layer 62.

To further enhance the thermal isolation properties of the tie system 10, it is preferred for the barriers 38, the hubs 14, 20, and/or the entire tie system 10 to be formed of, or coated with, a material having a thermal conductivity that is less than steel, preferably less than concrete. For instance, the barriers 38, the hubs 14, 20, and/or the entire tie system 10 may be formed of, or coated with, a material having a thermal conductivity less than 10, 5, 1, 0.5, or 0.1 W/(m·K). In some embodiments, the barriers 38, the hubs 14, 20, and/or the entire tie system 10 may formed from a synthetic resin, such as an epoxy. In further embodiments, the synthetic resin may include reinforcing fibers, such as glass fibers and/or carbon fibers.

Figure 12:
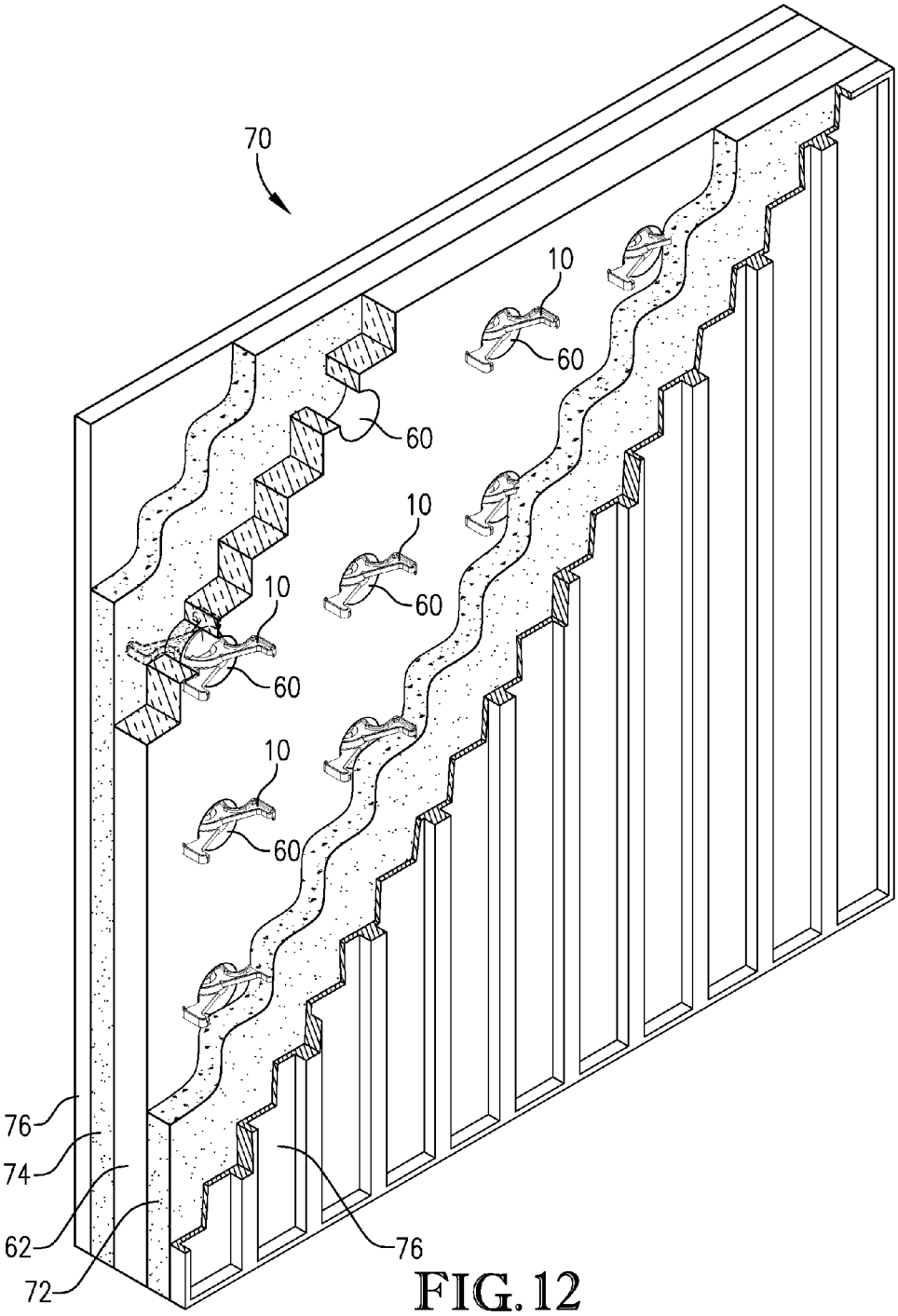
FIG. 12 is an illustration of an insulated concrete panel formed from an insulation layer, a top layer of concrete, a bottom layer of concrete, and a plurality of the tie systems from FIGS. 1-6.

As illustrated in FIG. 12, after the tie system 10 has been inserted into a tie opening 60 of an insulation layer 62, and after the tie system 10 has been shifted into the expanded configuration so as to engage the insulation layer 62, an insulated concrete panel 70 can be manufacture by pouring top and bottom concrete layers 72, 74 on opposite sides of the insulation layer 62. The insulated concrete panel can have a variety of sizes. For some insulated concrete panels, tie systems 10 will be positioned throughout the insulated concrete panels approximately every 8 to 10 square feet (FIG. 12 may not be drawn to scale, but is provided for illustration of an insulated concrete panel having a plurality tie systems 10 included therein). In some cases of high loading, the tie systems 10 will need to be positioned closer together. Typical insulated concrete panels can include between 10 to 100, between 20 to 80, or between 25 to 40 tie systems 10 within each insulated concrete panel. The tie systems 10 can be aligned along a longitudinal or transverse direction of the insulated concrete panel 70 or at any other angle as deemed necessary by an engineer. In other embodiments, outer panels 76, such as facades may be positioned exterior of the top and bottom layers of concrete 72, 74.

With continued reference to FIG. 12, to form the insulated concrete panel 70, the bottom layer of concrete 74 is poured in a concrete form. Immediately following pouring the bottom layer of concrete 74, the insulation layer 62 with tie systems 10 coupled thereto can be lowered into engagement with the bottom layer of concrete 74. The end portions 50 of the tie systems 10 that extend down from a bottom surface of the insulation layer 62 become inserted into and embedded in the bottom layer of concrete 74. The bottom surface of the insulation layer 62 may be inserted within at least a top surface of the bottom layer of concrete 74. Reinforcement in the form of rebar, steel mesh, or prestress strand may also be inserted into the bottom layer of concrete 74. In some cases the tie systems 10 may need to be turned in the tie opening 60 or even relocated a few inches away, so as to avoid contact with any such reinforcements. The tie system 10 may be flexible enough to accommodate such turning and/or relocation.

Subsequent to placing the insulation layer 62 and tie systems 10 on and/or in the bottom layer of concrete 74, the top layer of concrete 72 can be poured on a top surface of the insulation layer 62. When the top layer of concrete 72 is poured, the end portions 50 of the tie systems 10 that extend up from the top surface of the insulation layer 62 become embedded in the top layer of concrete 72. During pouring of the top layer of concrete 72, the barriers 38 of the tie systems 10 inhibit passage of concrete from the top layer 72 entirely through the tie opening 60 in the insulation layer 62 and into contact with the bottom layer of concrete 74. As such, a continuous air void can be maintained in the tie opening 60, above the bottom layer of concrete 74 and below the barriers 38. In some embodiments, however, at least a portion of the tie opening 60 will be filled with concrete from the first and/or second layers of concrete 72, 74. Nevertheless, embodiments provide for at least 10%, 20%, 30%, or 40% of a volume of the tie opening 60 to be filled with the air void. Such an air void improves thermal isolation between the top and bottom layers of concrete 72, 74, even with such top and bottom layers 72, 74 being indirectly connected via the tie systems 10.

As such, embodiments of the present invention include an insulated concrete panel 70 comprising: an insulation layer 62 with a tie opening 60 extending therethrough, first and second concrete layers 72, 74 disposed on generally opposite sides of the insulation layer 62, and at least one tie system 10 interconnecting the concrete layers. As discussed above, the tie system 10 may comprise: hubs 14, 20 (collectively, a "hub portion") at least partly receive in the tie opening 60 of the insulation layer 62, a first end section 64 at least partly embedded in the first concrete layer 72, and a second end section 66 at least partly embedded in the second concrete layer 74, with the tie system 10 being capable of shifting from a collapsed configuration, in which a maximum width Wc of the first and second end sections 64, 66 is less than a maximum width Wo of the tie opening 60, to an expanded configuration, in which the maximum width We of the first and second end sections 64, 66 is greater than the maximum width Wo of the tie opening 60.

Figure 13:
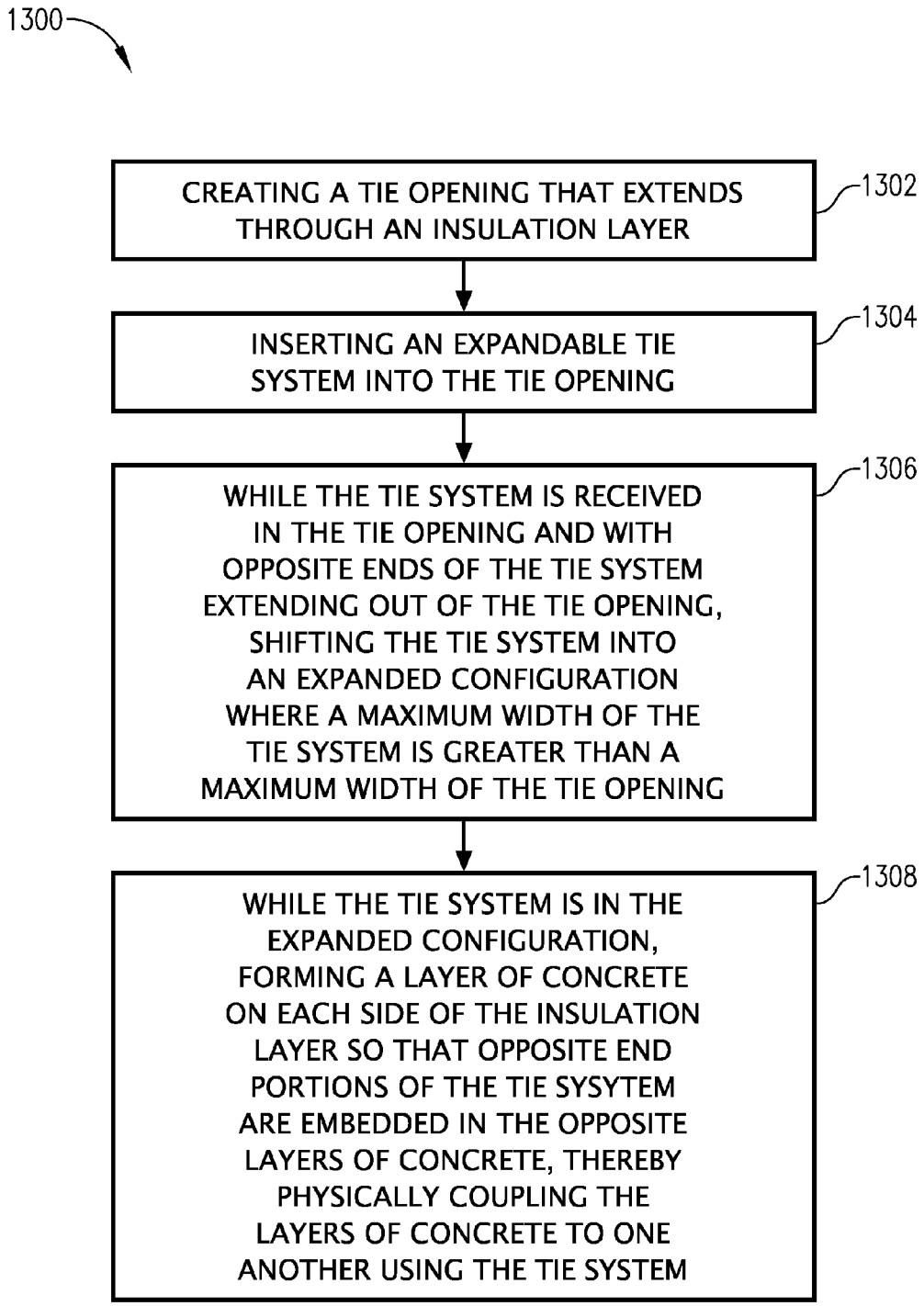
FIG. 13 is a flow chart illustrative of a method for making an insulated concrete panel according to embodiments of the present invention.

Thus, as illustrated in FIG. 13, embodiments of the present invention include a method 1300 of making an insulated concrete panel. The method 1300 includes the initial Step 1302 of creating a tie opening that extends through an insulation layer. A next Step 1304 includes inserting an expandable tie system into the tie opening. Thereafter, in Step 1306, while the tie system is received in the tie opening and with opposite ends of the tie system extending out of the tie opening, shifting the tie system into an expanded configuration where a maximum width of the tie system is greater than a maximum width of the tie opening. In final Step 1308, while the tie system is in the expanded configuration, a layer of concrete is formed on each side of the insulation layer so that opposite end portions of the tie system are embedded in the opposite layers of concrete, thereby physically coupling the layers of concrete to one another using the tie system. Once the top and bottom layers of concrete 72, 74 have at least partially cured, the concrete form(s) (if used) can be removed and the concrete insulation panel 70 is prepared to be lifted and or shipped to a jobsite for installation.

As illustrated in the drawings, the tie systems 10 are generally formed so as to present an "X" shape with an intersection of the X-shape being located at the hubs 14, 20. The "X" shape of the tie systems 10 allows for the tie systems 10 to effectively transfer shear forces between the layers of concrete 72, 74 without deforming the insulation layer 62 therebetween. As such, the resulting insulated concrete panel 70 is configured as a composite panel. The tie system 10 is also configured to act as a tension member that will prevent the top and bottom layers of concrete 72, 74 from delamination during lifting and shipping. Further, as mentioned, the insulated concrete panel 70 can be reinforced with rebar, steel mesh, post tension cables, priestess strand, or a combination of reinforcement as needed by the particular job requirements so as to further reinforce the insulated concrete panel 70.

Multi-Material Tie Device and System

Embodiments of the present invention provide for an additional embodiment of a tie system, which is illustrated as tie system 80 in FIGS. 14-15. The additional tie system 80 functions in substantially the same manner as the tie system 10 depicted in FIGS. 1-13; however, each structural member 12, 18 of the additional tie system 80 is formed from more than one material. In more detail, in the additional tie system 80 depicted in FIGS. 14-15, a material of construction of each of the tie system's 80 hubs 14, 20 is different that a material of construction of each of the extension members 16, 22. Specifically, the extension members 16, 22 may be separable from the hubs 14, 20, respectively.

For example, each of the extension members 16, 22 may include a base 82 comprising extension connection elements 84. In certain embodiments, such connection elements 84 of the extension members 16, 22 will further include protrusions 88 (See FIG. 15). Correspondingly, each of the hubs 14, 20 may include connection elements 86. Such connection elements 86 of the hubs 14, 20 may be formed with cavities 90 (See FIG. 14). In such embodiments, the protrusions 88 may be configured to be received within the cavities 90, such that the extension members 16, 22 can be removable secured to the hubs 14, 20.

Given the above, each of the extension members 16, 22 can be formed of a material of high thermal conductivity (e.g., steel), while each of the hubs 14, 20 can be formed of a material of low thermal conductivity (e.g., a synthetic resin or fiber-reinforced composite material). Such a configuration allows for an ultra-high strength, thermally conductive material to be used for the extension members 16, 22 (for transmitting shear forces though a relatively small section), and for a thermally insulating material to be used for the hubs 14, 20 (for inhibiting heat transfer). In certain embodiments, the high strength material (e.g., steel) used for the extension members 16, 22 will provide for the tie systems 80 to have a tensile strength of at least 10,000 psi. The insulating material used for the hubs 14, 20 may include a synthetic resin, such as an epoxy. In some embodiments, a ratio of the thermal conductivity of the material used in the extension members 16, 22 to the material used for the hubs 14, 20 can be at least 2:1, at least 5:1, at least 10:1, or at least 50:1. For instance, the thermal conductivity of the extension members 16, 22 can be at least 1, at least 5, at least 10, or at least 20 W/(m·K), while the thermal conductivity of the hubs 14, 20 can be less than 5, less than 2, less than 1, less than 0.5, or less than 0.1 W/(m·K).

As shown in FIGS. 14-15, the inwardly-facing side 30 of the first structural member 12 can include one or more positioning nubs 92 (See FIG. 14), while the inwardly facing side 30 of the second structural member 18 can be configured with a plurality of spaced-apart positioning notches 94 (See FIG. 15). The positioning notches 94 are sized and located to receive the positioning nubs 92 as the first and second structural members 12, 18 are rotated relative to one another. When the positioning nubs 92 are received in the positioning notches 94, relative rotation of the first and second structure members 12, 18 is inhibited. As with the previously-described ribs 34, having a plurality of positioning notches 94 at different locations enables the first and second structural members 12, 18 of the additional tie system 80 to be "locked" in various relative rotational positions. As such, the additional tie system 80 can be used with insulation layers of varying thickness.

In certain embodiments, the extension members 16, 22 are manufactured first and then placed in a mold for connection with the hubs 14, 20 while the hubs 14, 20 are being manufactured. In this manner, the hubs 14, 20 can be formed around connection elements 84 at the base 82 of each extension member 16, 22 to ensure a strong and secure connection between the extension members 16, 22 and the hubs 14, 20. When the hubs 14, 20 are formed of a synthetic resin material, the extension members 16, 22 can be coupled to the hubs 14, 20 by first inserting the bases 82 of the extension members 16, 22 into a mold (e.g., an injection molding form) and then introducing the synthetic into the form so that the resin surrounds the connection elements 84 at the base 82 of the extension members 16, 22. If it is desired for the hub to be formed of a fiber-reinforce composite material, the reinforcing fibers can be placed in the mold before and/or during addition of the synthetic resin. In other embodiments, the extension members 16, 22 and hubs 14, 20 can be separately manufactured and then later attached to one another via any know fastening mechanisms such as, for example, screws, bolts, press-fitting, etc.

In further embodiments, each of the four extension members 16, 22 that make up the additional tie system 80 can have an identical configuration, thereby reducing manufacturing costs. Additionally, each of the two hubs 14, 20 of the additional tie system 80 can initially be manufactured with an identical configuration and then later modified to mate with one other. For example, both hubs 14, 20 of the additional tie system 80 can be being identically manufactured with the hub recess 26 and no hub projection 24. As such, when both hubs 14, 20 are identically manufactured with a hub recess 26, a separately manufactured hub projection 24 can be inserted (e.g., press-fit) into one of the hub recesses 26 after initial manufacturing of the hubs 14, 20, thus allowing one of the hubs 14, 20 to be provided with a hub projection 24 that can be matingly received in the hub recess 26 of the other hub 14, 20.

As previously described, the extension members (e.g., 16 or 22) can be formed of a metallic material, such as steel. Although not illustrated in the drawings, in certain embodiments, the extension members (e.g., 16 or 22) may be formed by cutting an initial flat elongated member from a large sheet and then bending the flat member into the final shape of an extension member (e.g., 16 or 22). Such cutting may include stamping the elongated flat member out of the metallic sheet. The bending forms the perimeter sidewalls 42 at the outer perimeter of the extension members (e.g., 16 or 22) and also forms the connection elements 84 at the base 82 of the extension members (e.g. 16, 22). As such, the two extension members (e.g., 16 or 22) can be rigidly connected via a hub (e.g., 14 or 20).

For instance, in some embodiments, the hub (e.g., 14 or 20) can be formed around the base 82 of the extension members (e.g., 16 or 22) so that said base 82 of each of the extension members (e.g., 16 or 22) is at least partly embedded in the hub (e.g., 14 or 20). In more detail, the base 82 of each of the extension members (e.g., 16 or 22) may be placed in a hub form and thereafter the hub form may be filled with a synthetic resin to thereby form the hub (e.g., 14 or 20). As previously described, the synthetic resin may include an epoxy. In further embodiments, reinforcing fibers (e.g., glass fibers and/or carbon fibers) can be included in the hub form before and/or during filling of the hub form with said synthetic resin. Furthermore, in some embodiments the hub (e.g., 16 or 22) may include a hub recess 26. As such, a hub projection 24 may be inserted into the hub recess 26 and attached to the hub recess 26 via press-fitting.

The previously-described bending of the flat members forms the perimeter sidewalls 42 which may be bent substantially perpendicular to the main sidewall 40 of the extension members (e.g., 16 or 22). As such, an open void 44 is defined within the perimeter sidewalls 42 of the extension members (e.g., 16 or 22). In certain embodiments, the bending further forms the connection elements 84 at the base 82 of the extension members (e.g., 16, 22), with such connection elements

84 being used to secure the extension members (e.g., 16, 22) to the hub (e.g., 14 or 20), as previously described.

The multi-material tie system shown in FIGS. 14-15 can be used to form an insulated concrete panel 70 in the same manner as describe above with respect to the single-material tie system shown in FIGS. 1-13. Thus, a description of how the multi-material tie system is positioned into the insulation layer 62 and then used to connect top and bottom concrete layers 72, 74 on each side of the insulation layer 62 is the same as described above for tie system 10.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following.

What is claimed is:

1. A tie system for an insulated concrete panel, said tie system comprising:

a first structural member comprising a first hub and a pair of first extension members coupled to said first hub, wherein said first extension members extend outwardly from said first hub in different directions; and a second structural member comprising a second hub and a pair of second extension members coupled to said second hub, wherein said second extension members extend outwardly from said second hub in different directions;

wherein said first and second hubs are configured to be rotatably coupled to one another in a manner that permits rotation of said first and second hubs relative to one another on an axis of rotation extending through said first and second hubs, wherein when said first and second hubs are rotatably coupled to one another said tie system is shiftable between a collapsed configuration and an expanded configuration by rotating said first and second structural members relative to one another on said axis of rotation, wherein when said tie system is in said collapsed configuration said tie system presents opposing ends and said tie system is elongated along an axis of elongation extending between said opposing ends, wherein said axis of rotation is orthogonal to said axis of elongation when said tie system is in said collapsed configuration, wherein at least one of said first and second hubs includes one or more protuberances, wherein the other of said first and second hubs includes one or more cavities, wherein said first and second hubs are configured to engage with each other, with at least one of said protuberances being received in at least one of said cavities, to thereby hold said first and second structural members in a plurality of different relative rotational positions, wherein, at distal ends thereof, each of said first and second extension members includes an enlarged end portion comprising oppositely facing heel and toe portions, and wherein an entirety of each of said first and second extension members is a continuous unitary structure of one-piece rigid construction.

2. The tie system of claim 1, wherein said first and second structural members are rotatably coupled to one another in a scissor-like configuration.

3. The tie system of claim 1, wherein each of said first and second hubs include a plurality of said protuberances and a plurality of said cavities, wherein said cavities are formed between said protuberances, wherein said protuberances are configured as radially-extending ribs.

4. The tie system of claim 1, wherein said first and second extension members each comprise a main sidewall and a perimeter sidewall extending substantially perpendicular to said main sidewall, such that an open void is defined by said main sidewall and said perimeter sidewall.

5. The tie system of claim 1, wherein one of said first and second hubs comprises a hub recess and the other of said first and second hubs comprises a hub projection, wherein said hub projection is received in said hub recess when said first and second hubs are rotatably coupled to one another, and wherein receipt of said hub projection in said hub recess inhibits translation of said first and second structural members relative to one another while permitting rotation of said first and structural members relative to one another on said axis of rotation while said tie system is shifted between said collapsed and expanded configurations.

6. The tie system of claim 1, wherein each of said first and second hubs comprises a barrier presenting a rounded outer profile, wherein each of said barriers is shaped as a half disk.

7. The tie system of claim 1, wherein shifting of said tie system from said collapsed configuration to said expanded configuration increases a maximum width of said tie system and decreases a maximum length of said tie system.

8. The tie system of claim 7, wherein when said tie system is in said collapsed configuration the maximum width of said tie system is less than a maximum width of said first and second hubs, and wherein when said tie system is in said expanded configuration the maximum width of said tie system is greater than the maximum width of said first and second hubs.

9. The tie system of claim 1, wherein each of said first and second extension members are formed of a different material than each of said first and second hubs, and wherein a thermal conductivity of said first and second extension members is greater than a thermal conductivity of said first and second hubs.

10. The tie system of claim 9, wherein a ratio of the thermal conductivity of the material of construction of said first and second extension members to the thermal conductivity of the material of construction of said first and second hubs is at least 5:1.

* * * * *